US005605024A

United States Patent [19]

Sucato et al.

[11] Patent Number: 5,605,024

[45] Date of Patent: Feb. 25, 1997

[54] STUD ASSEMBLY

[76] Inventors: Edward Sucato, 3102 N. 24th St., Phoenix, Ariz. 85016; John A. Powers, III, 4118 E. Ellwood St., Phoenix, Ariz. 85040

[21] Appl. No.: 552,104

[22] Filed: Nov. 2, 1995

Related U.S. Application Data

[63] Continuation-in-part of Ser. No. 192,599, Feb. 7, 1994.

[51] Int. Cl.[6] ..... E04C 3/32

[52] U.S. Cl. ..... 52/696; 52/671; 52/729.5; 52/731.9; 52/733.2

[58] Field of Search ..... 52/690, 696, 671, 52/672, 675, 676, 729.2, 729.3, 729.5, 731.1, 731.7, 731.8, 731.9, 733.2

[56] References Cited

U.S. PATENT DOCUMENTS

| | | | |
|---|---|---|---|
| 768,594 | 8/1904 | Finlay . | |
| 1,011,583 | 12/1911 | Collins . | |
| 1,242,892 | 10/1917 | Wagner . | |
| 1,360,720 | 11/1920 | Brown et al. . | |
| 1,696,039 | 12/1928 | Kane . | |
| 1,762,112 | 6/1930 | White . | |
| 1,839,178 | 12/1931 | Rebman . | |
| 1,849,811 | 3/1932 | Smiley, Jr. . | |
| 1,891,240 | 12/1932 | Pearce | 52/672 |
| 2,082,792 | 6/1937 | Dean . | |
| 2,089,023 | 8/1937 | Hahn . | |
| 2,141,642 | 12/1938 | Cross . | |
| 2,157,233 | 5/1939 | Geib, Jr. . | |
| 2,177,277 | 10/1939 | Burke | 52/634 |
| 2,219,806 | 10/1940 | Buttress | 52/671 |
| 2,284,898 | 6/1942 | Hartman . | |
| 2,668,606 | 2/1954 | King . | |
| 2,998,108 | 8/1961 | Stoner et al. . | |
| 3,656,270 | 4/1972 | Phillips . | |
| 3,872,636 | 3/1975 | Nicosia | 52/672 |
| 3,995,403 | 12/1976 | Nickell . | |
| 4,291,515 | 9/1981 | Harding . | |
| 4,720,957 | 1/1988 | Madray | 52/731.7 |
| 4,793,113 | 12/1988 | Bodnar | 52/634 |
| 5,095,678 | 3/1992 | Murphy . | |

FOREIGN PATENT DOCUMENTS

| | | | |
|---|---|---|---|
| 1162523 | 6/1960 | France . | |
| 2205875 | 12/1988 | United Kingdom . | |
| 05872 | 3/1994 | WIPO | 52/731.7 |

*Primary Examiner*—Michael Safavi
*Attorney, Agent, or Firm*—Warren F. B. Lindsley

[57] ABSTRACT

An assembly of parts which form a stud for construction use. This stud assembly greatly reduces the material content of the stud assembly and reduces heat transfer and noise transmission over the known prior art and comprises two parallely arranged U-shaped channels interconnected by a novel mesh connector which interconnects the channels at one or more points along their length and is expandable only in a direction transverse to the longitudinal axes of the channels.

2 Claims, 3 Drawing Sheets

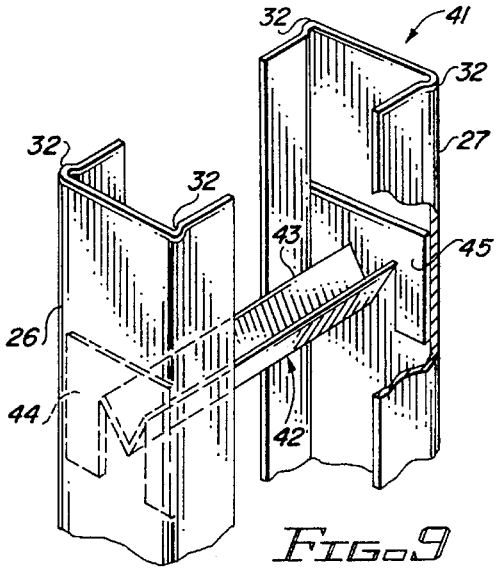
FIG. 9
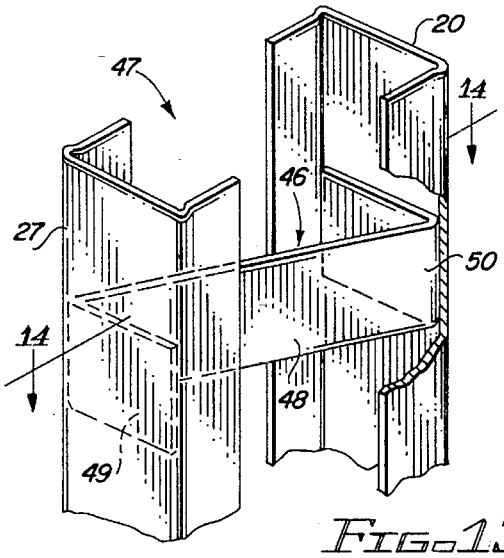
FIG. 13
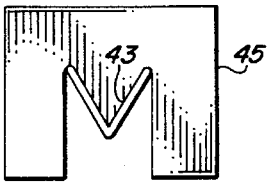
FIG. 10
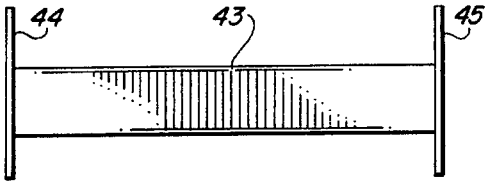
FIG. 11
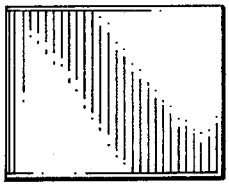
FIG. 15
FIG. 12
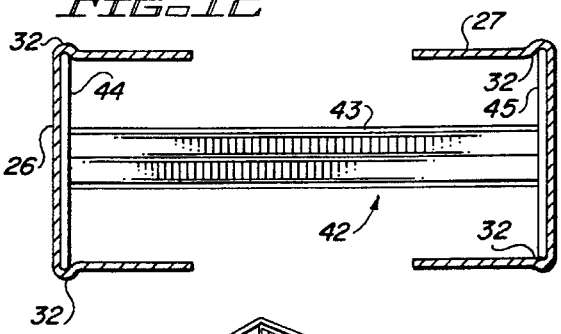
FIG. 14
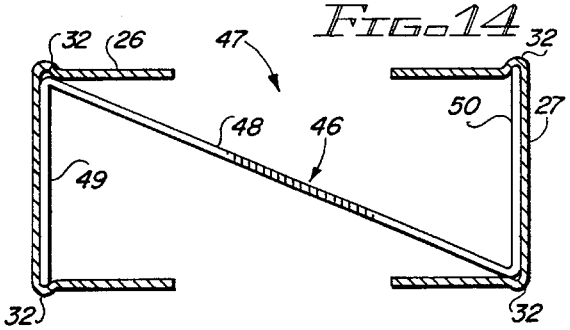
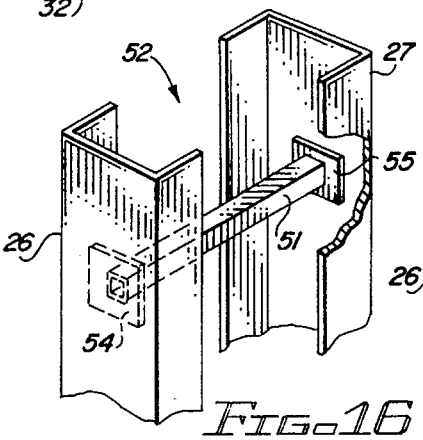
FIG. 16
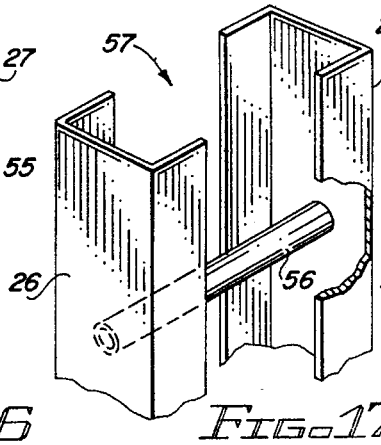
FIG. 17
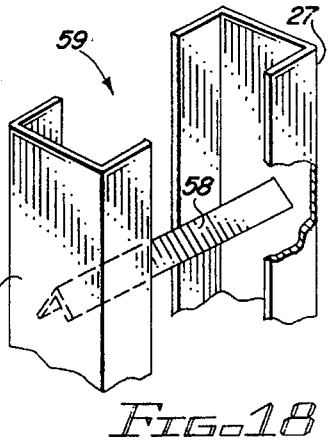
FIG. 18

STUD ASSEMBLY

BACKGROUND OF THE INVENTION

This application is a continuation in part application of U.S. Patent Application Ser. No. 08/192,599 filed Feb. 7, 1994 by Edward Sucato and John A. Powers III and entitled STUD ASSEMBLY.

This invention relates to channels or studs for walls of buildings and more particularly to a stud assembly comprising a pair of channels held together by a stiffener at one or more points or places along their length to form a new and improved stud assembly.

DESCRIPTION OF THE PRIOR ART

Todate, the studs of buildings comprise U-shaped configurations the legs of which are bent over at a ninety degree angle to face each other. These studs forming channels were usually formed of metal thick enough to form a rigid structure and because of the metal content are costly to manufacture and the solid configuration allows a higher degree of heat transfer. Thus, a need exists for a plastic or metal stud or channel structure which will serve its function, contain a reduced amount of plastic or metal content, reduces heat transfer and noise transmission and retain the rigidity or stiffness of the prior art structures.

The following U.S. patents disclose studs and ceiling joists employing a cross member for stiffening the structure.

| | |
|---|---|
| 1,011,583 | 1,849,811 |
| 1,242,892 | 2,089,023 |
| 1,360,720 | 2,141,642 |
| 1,696,039 | 2,157,233 |
| 1,762,112 | 2,668,606 |
| 1,839,178 | |

U.S. Pat. No. 2,998,108 discloses a structural post assembly for walls employing an interlocking bite.

U.S. Pat. No. 3,995,403 discloses a structural building module employing sections joined together by cross members.

U.S. Pat. No. 4,291,515 discloses a structural element employing a webbing in the form of a zig-zag strip.

U.S. Pat. No. 5,095,678 discloses a structural stud having an open faced end flange that can be snap fitted into the end of a similar stud.

The British patent application GB 2205875A discloses a composite beam having parts to fill both sides of a wall.

U.S. Pat. No. 768,594 to Finlay discloses a hollow tube c2 connected to a bite of channels b2.

U.S. Pat. No. 2,082,792 to Dean shows a trough at 15 or 16 with a connection at 7 to U-shaped channel members 1, 2.

U.S. Pat. No. 2,284,898 to Hartman shows interchangeable structural units for building construction.

U.S. Pat. No. 3,656,270 to Phillips discloses a structural member having male and female parts utilizing an adhesive disposed between these parts to bond them together.

French patent 1,162,523 shows a mesh connected to parallel side rails. The diamond shaped mesh is oriented perpendicular to the long axes of the side rails to preclude expansion or adjustment of the spacing between the side rails.

None of these patents disclose the claimed structure set forth within.

SUMMARY OF THE INVENTION

In accordance with the invention claimed, a new and improved stud is provided for wall, ceiling joist and floor use in building construction. This stud comprises an assembly of parts which attach into a solid, rigid stud assembly which greatly reduces the amount of material needed to form the assembly over the prior art structures.

The claimed assembly comprises a pair of U-shaped channels the legs of which are arranged to face each other in a parallel spaced arrangement and are interconnected by a rigid stiffener. This stiffener extends between the U-shaped channels and into the legs of each of the channels to attach them in a rigid configuration to form the novel stud assembly.

BRIEF DESCRIPTION OF THE DRAWINGS

The present invention may be more readily described by reference to the accompanying drawings in which:

FIG. 9 is a perspective view of the stud a modification of the stiffener shown in FIG. 2;

FIG. 10 is a cross sectional view of the stiffener shown in FIG. 9;

FIG. 11 is a side view of the stiffener shown in FIG. 9;

FIG. 12 is a top view of FIG. 9;

FIG. 13 is a perspective view of a further modification of the stiffener shown in FIGS. 2 and 9;

FIG. 14 is a cross sectional view of FIG. 13 taken along the line 14—14;

FIG. 15 is an end view of the stiffener shown in FIG. 14;

FIGS. 16–18 are perspective views of modifications of the stiffeners shown in FIGS. 2–15;

FIG. 19A is a view showing the stiffener before insertion between the studs;

DESCRIPTION OF THE PREFERRED EMBODIMENT

Figure 1:
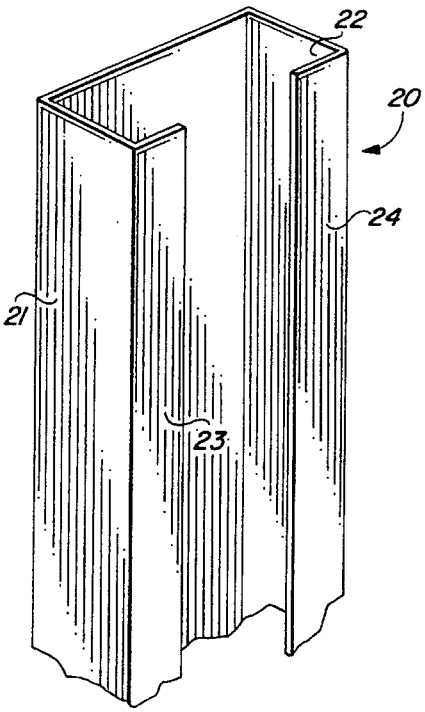
FIG. 1 (PRIOR ART)
FIG. 1 is a perspective view of the prior art stud for mounting in or forming a part of a wall, ceiling joist or floor assembly of a building.
Figure 4:
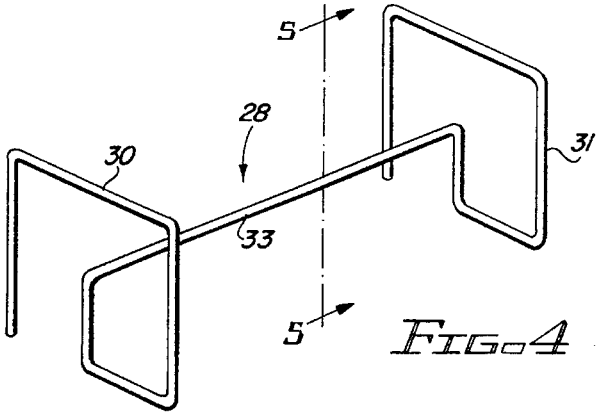
FIG. 4 is a perspective view of the stiffener shown in FIGS. 2 and 3.
Figure 5:
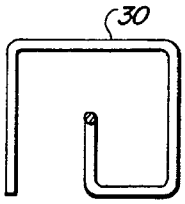
FIG. 5 is a cross sectional view of FIG. 4 taken along the line 5—5.
Figure 6:
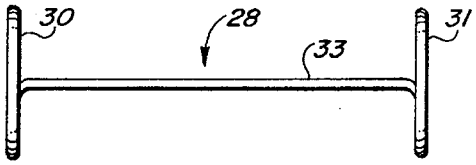
FIG. 6 is a top view of FIG. 4.

Referring more particularly to the drawings by characters of reference, FIG. 1 discloses the prior art which comprises a stud 20 formed of plastic or metal which is bent or formed into a U-shaped channel like configuration. Legs 21 and 22 of stud 20 are laterally bent at their ends to form ninety degree like portions 23 and 24 which face each other in common planes.

Figure 2:
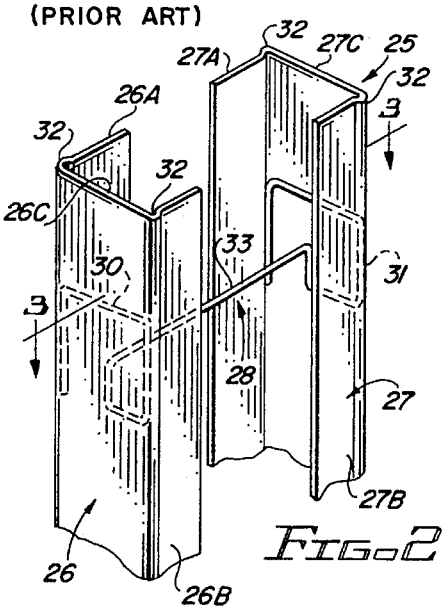
FIG. 2 is a perspective view of an improved stud serving the same functions as the prior art stud shown in FIG. 1 and embodying the invention.

FIG. 2 illustrates a modification of the prior art structure shown in FIG. 1 wherein channel or stud assembly 25 comprises two members 26 and 27. These members may be formed of suitable materials such as plastic or metal each bent into a U-shaped configuration as shown. The U-shaped configurations 26 and 27 comprises legs 26A, 26B and 27A, 27B, respectively interconnected by bites 26C and 27C.

As shown in FIGS. 2–6, an elongated stiffening member 28 is provided for extending between and interlocking with members 26 and 27 of stud 25 to hold members 26 and 27 in a stiff rigid condition.

Member 28 is formed of a rigid wire or rod that is bent laterally of its length at each of its ends to provide feet 30 and 31 of identical configuration that rest against and interlock and/or attach with the inside surface of members 26 and 27. As noted from FIG. 2, each of the inside corners of members 26 and 27 are deformed to provide notches 32 into which the feet 30 and 31 of member 28 are snapped or forced into for interlocking or attaching members 26 and 27 into a firm rigid stud assembly.

As noted, feet 30 and 31 are formed into a substantially rectangular configuration which are in parallel spaced planes with the ends of the center portion 33 extending to and against the inside surface of members 26 and 27.

Figure 7:
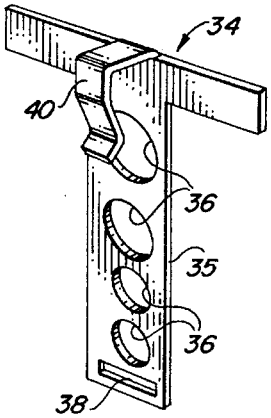
FIG. 7 is a perspective view of a plastic or metal strap that can be suspended from the cross member of the stiffener shown in FIGS. 2, 3 and 4 for supporting conduits, pipes and the like extending between studs in a wall, ceiling joist or floor assembly.
Figure 8:
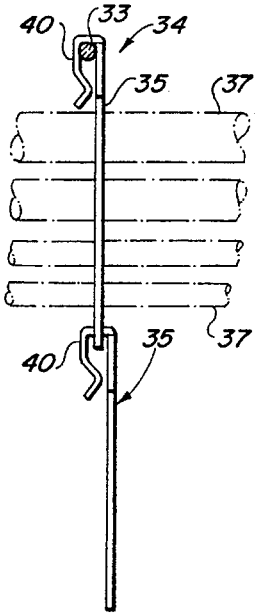
FIG. 8 is a side view of the strap shown in FIG. 7 illustrating it in series with another like strap and showing pipes or conduits being supported by one of the straps.
Figure 3:
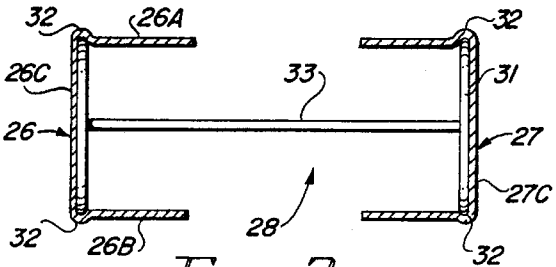
FIG. 3 is a cross sectional view of FIG. 2 taken along the line 3—3.

FIG. 7 illustrates a T-shaped hanger 34 the leg 35 of which is provided with a plurality of like or different size apertures 36 extending therethrough along its length for receiving and supporting one or more conduits, wires, pipes 37, slots 38 or the like which are shown in dash lines in FIG. 8 for purposes of illustration. Each hanger is provided with a catch or snap clamp 40 for snapping over the center portion of stiffener member 33 of the stud assembly.

FIGS. 9–12 illustrate a modification of the stud shown in FIGS. 2–8 wherein like parts are given the same reference characters. This stud 41 differs from stud 25 in the design configuration of the stiffener 42 which comprises an elongated V-shaped trough 43 having at each end thereof foot configurations 44 and 45 extending laterally thereof in parallel planar configurations. Each foot comprises a flat planar configuration the side edges of which fit into the interlock or attach with notches 32 formed in the corners of members 26 and 27, as heretofore described, for the structure shown in FIGS. 2–8.

FIGS. 13–15 disclose a further modification of the studs shown in FIGS. 2–12 wherein the stiffener 46 of stud 47 comprises a zig-zag or Z-shaped configuration formed by a strip of metal 48 bent in a Z-shaped configuration the legs 49 and 50 of which are formed in planar configurations with the side edges of each leg fitting into notches 32.

FIGS. 16–19 disclose further modifications of the studs shown in FIGS. 2–15 wherein like parts of other studs disclosed herein are given like reference characters with one stud therein differing from the other studs by the design configuration of the stiffener and the manner of its attachment to the inside surfaces of members 26 and 27.

In FIG. 16, stiffener 51 of stud 52 comprises a hollow elongated channel having a square cross sectional configuration with flat feet 54 and 55 at each end secured to the inside surface of members 26 and 27 by any suitable means such as, for example, welding.

FIG. 17 discloses a like configuration wherein stiffener 56 of stud 57 comprises a hollow elongated tubular configuration fastened to the inside surfaces of members 26 and 27 to form a rigid assembly.

FIG. 18 discloses a similar configuration wherein members 26 and 27 are held together in a spaced relationship by an inverted V-shaped trough 58 to form a stud configuration 59.

Figure 19:
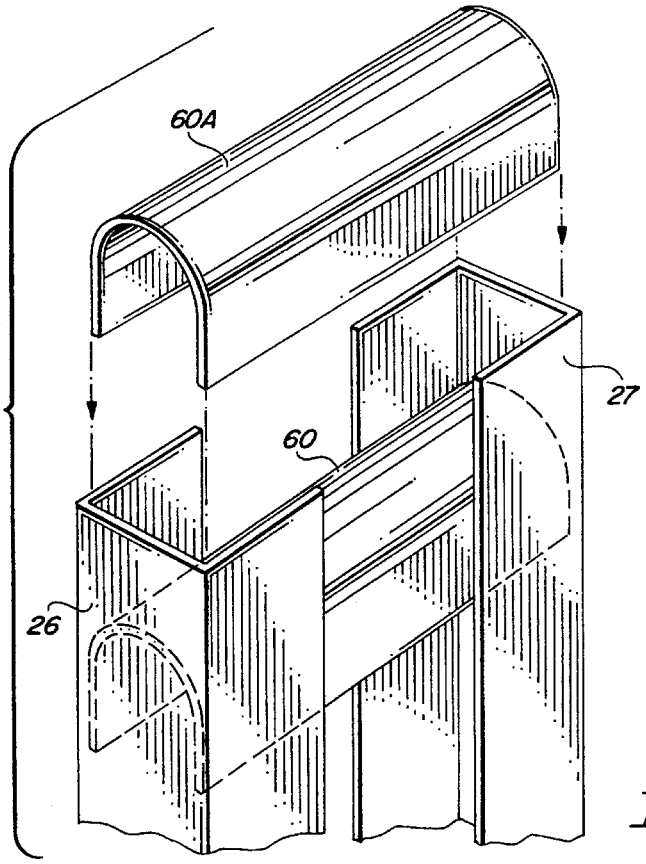
FIG. 19 is a further perspective view of a stud showing an inverted U-shaped stiffener.

FIG. 19 discloses a similar configuration wherein members 26 and 27 are held together by an inverted U-shaped trough 60 showing trough 60A before its insertion in the stud assembly.

Figure 20:
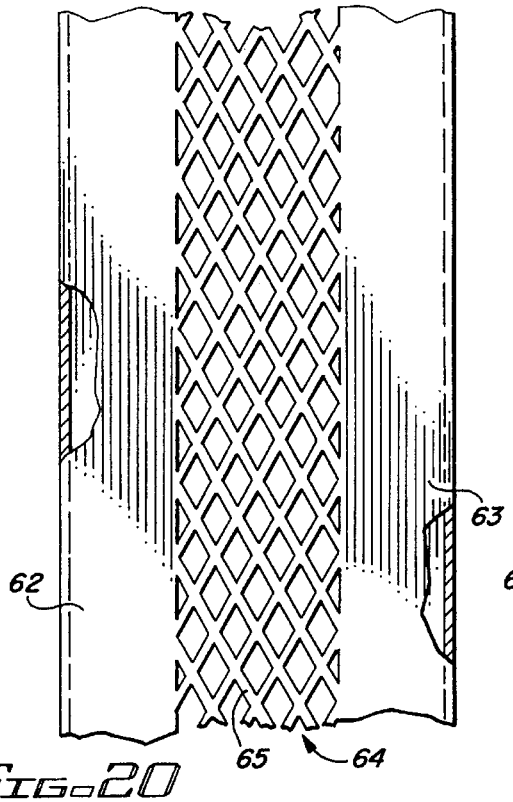
FIG. 20 is a front elevational view of a expandable metal purlin joist or truss embodying the invention before expansion.
Figure 21:
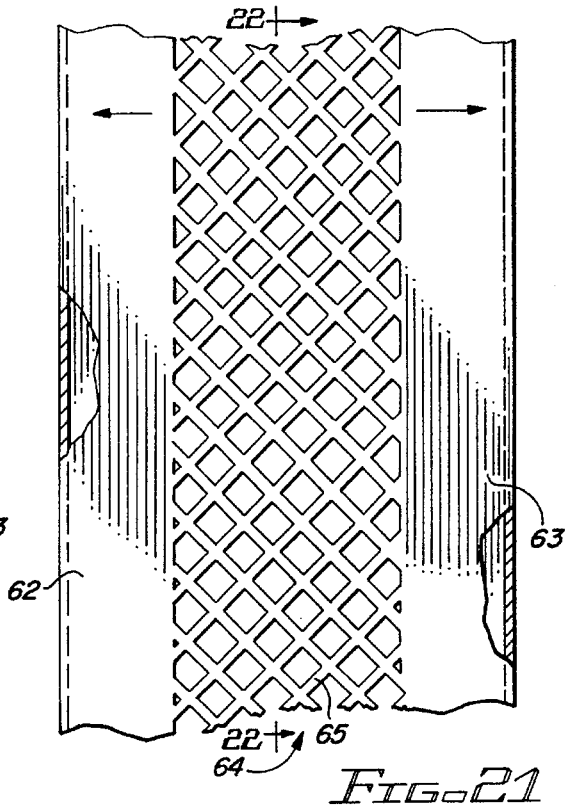
FIG. 21 is a front elevational view of the joist shown in FIG. 20 in its expanded condition.

FIGS. 20 and 21 disclose a stud 61 comprising a pair of U-shaped members 62 and 63 which may be formed of a metallic material that are interconnected by bight 64 comprising an expandable mesh 65. The expandable mesh originally comprised a flat piece of metal stamped to form a mesh configuration the physical orientation of which may be varied by moving one of the members 62 and 63 away from or toward the other as indicated by the arrows in FIG. 21, to increase or decrease the width of the mesh.

Figure 22:
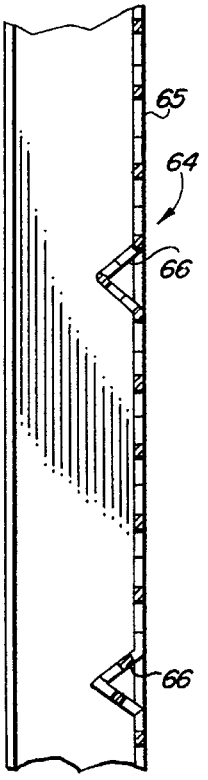
FIG. 22 is a cross sectional view of FIG. 21 taken along the line 22—22.

FIG. 22 is a cross sectional view of FIG. 21 with a crease line or indentation 66 added to neck 65 to strengthen the mesh when the stud is in its expanded position.

Thus, the metal mesh has openings adapted to expand only in a direction transverse to the longitudinal axes of the channel members.

Although but a few embodiments have been illustrated and described, it will be apparent to those skilled in the art that various changes and modifications may be made therein without departing from the spirit of the invention or from the scope of the appended claims.

What is claimed is:

1. A stud assembly comprising first and second elongated channel members of hollow U-shaped metal construction each comprising a pair of parallel sidewalls interconnected by a connecting wall, each sidewall of said channel members facing a similar sidewall of the other of said channel members in a common plane, and an elongated connecting member integrally connecting said first and second channel members for holding said channel members in inwardly facing spaced parallel arrangement to form a hollow stud having a generally rectangular cross-section, wherein said connecting member comprises an elongated flat sheet of expanded metal mesh integrally joined along opposite side edges to corresponding facing sidewalls of said channel members, said metal mesh having openings adapted to expand only in a direction transverse to the longitudinal axes of said channel members, thereby enabling said channel members to be moved transversely away or toward each other in said transverse direction to adjust the spacing between said channel members and provide a stud assembly of desired width, wherein said expanded metal mesh is creased at points along its length to strengthen said stud assembly in its expanded position.

2. A stud assembly comprising first and second elongated channel members of hollow U-shaped construction each comprising a pair of parallel sidewalls interconnected by a connecting wall, each sidewall of said channel members facing a similar sidewall of the other of said channel members in a common plane, an elongated connecting member integrally connecting said first and second channel members for holding said channel members in inwardly facing spaced parallel arrangement to form a hollow stud having a generally rectangular cross-section, wherein said connecting member comprises an elongated flat sheet of slit metal mesh integrally joined along opposite side edges to corresponding facing sidewalls of said channel members, said slit metal mesh having openings adapted to expand only in a direction transverse to the longitudinal axes of said channel members, thereby enabling said channel members to be moved away from one another in said transverse direction to adjust the spacing between said channel members and provide a stud assembly of desired width, and wherein said mesh like configuration is creased to increase its strength.

* * * * *